US008277205B2

(12) United States Patent
Mellet et al.

(10) Patent No.: US 8,277,205 B2
(45) Date of Patent: Oct. 2, 2012

(54) ACTIVE ELECTRIC ACCUMULATOR

(75) Inventors: Edward W. Mellet, Rochester Hills, MI (US); Clinton E. Carey, Highland, MI (US); Carlos E. Marin, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 670 days.

(21) Appl. No.: 12/399,430

(22) Filed: Mar. 6, 2009

(65) Prior Publication Data

US 2010/0226806 A1 Sep. 9, 2010

(51) Int. Cl.
*F04B 17/03* (2006.01)

(52) U.S. Cl. ..... 417/417; 417/415; 417/540

(58) Field of Classification Search ..... 417/540, 417/415, 417, 419–420
See application file for complete search history.

(56) References Cited

U.S. PATENT DOCUMENTS

| | | | | |
|---|---|---|---|---|
| 4,522,270 | A * | 6/1985 | Kishi | 173/217 |
| 5,551,488 | A * | 9/1996 | Gram | 141/18 |
| 2007/0023211 | A1* | 2/2007 | Keller et al. | 180/65.2 |
| 2007/0137966 | A1* | 6/2007 | Francis et al. | 192/20 |
| 2008/0006411 | A1* | 1/2008 | Johansen et al. | 166/332.1 |
| 2008/0110704 | A1* | 5/2008 | Nakazeki | 188/158 |
| 2008/0196544 | A1* | 8/2008 | Kajino et al. | 74/7 E |
| 2009/0065527 | A1* | 3/2009 | Buck | 222/95 |

* cited by examiner

*Primary Examiner* — Karabi Guhary

(57) ABSTRACT

The present invention provides an active, electrically powered hydraulic fluid accumulator. The accumulator includes an electric motor having its output coupled to a mechanical rotation to linear translation transducer such as a lead screw, ball spline or similar device. The output of the mechanical transducer is coupled to a piston disposed within an accumulator cylinder. The accumulator cylinder preferably communicates with a pair of inlet and outlet check valves disposed in hydraulic supply and feed lines from the system pump or sump and to the system, respectively.

15 Claims, 3 Drawing Sheets

ACTIVE ELECTRIC ACCUMULATOR

FIELD

The present disclosure relates to an accumulator for a hydraulic system and more particularly to an active accumulator having an electric motor for a hydraulic control system.

BACKGROUND

The statements in this section merely provide background information related to the present disclosure and may or may not constitute prior art.

Accumulators are common components in hydraulic operating and control systems. They are utilized to store a quantity of hydraulic fluid or oil under pressure so that during relatively brief periods of fluid consumption that either exceed the supply capacity of the system pump or during periods that the pump is not operating, there continues to be a sufficient supply of pressurized hydraulic fluid so that operating pressure and flow do not drop below a required minimums.

Such devices may be characterized as passive devices and typically take the form of a cylinder having a combined inlet and outlet port and a piston that is biased toward the inlet/outlet port by a compression spring, a gas on the side of the piston opposite the inlet/outlet port, latching solenoids or other means.

There exist certain problems associated with such devices which are the result of their passive operation. First of all, they generally do not accumulate fluid and thus provide their intended function until the system pump has operated long enough to generate a sufficiently high pressure and provide a quantum of excess fluid which is then directed to and stored in the accumulator. Thus, at system start-up and for a short period thereafter, an accumulator not only typically does not provide the function for which it is intended but will also actually consume pressurized fluid until it is charged thereby effectively lengthening the startup cycle of the system. Moreover, if the charge time of the accumulator is greater than the duration on an operating cycle, little or no operating benefit will be provided by the accumulator. Thus, both during system start-ups and short cycles of operation, a passive accumulator likely will not provide its intended function.

Furthermore, since an accumulator is passive, it cannot create a pressure any higher than that generated by the system pump. If the pump is failing or the system is undergoing a cold start and thus building pressure slowly, not only does the accumulator once again not provide its intended function but it is also unable to achieve any active corrective or compensatory action. The present invention is directed to overcoming these and other shortcomings of conventional, passive fluid accumulators.

SUMMARY

The present invention provides an active, electrically powered hydraulic fluid accumulator. The accumulator includes a bidirectional electric motor having its output coupled to a mechanical rotation to linear translation transducer such as a lead screw, ball spline or similar device. The output of the transducer is coupled to a piston disposed within an accumulator cylinder. The accumulator cylinder preferably includes a pair of inlet and outlet check valves communicating with hydraulic supply and feed lines from the system pump or sump and to the system, respectively. The active electric accumulator of the present invention has wide application in hydraulic systems such as hydraulic control systems and hydraulic control systems for motor vehicle automatic transmissions.

Thus it is an object of the present invention to provide an active hydraulic fluid accumulator for use in hydraulic systems.

It is a further object of the present invention to provide an active hydraulic fluid accumulator for use in hydraulic control systems.

It is a still further object of the present invention to provide an active hydraulic fluid accumulator having an electric motor for use in hydraulic systems.

It is a still further object of the present invention to provide an active hydraulic fluid accumulator having a mechanical rotation to translation transducer for use in hydraulic systems.

It is a still further object of the present invention to provide an active hydraulic fluid accumulator having an electric motor and a mechanical rotation to translation transducer for use in hydraulic systems.

It is a still further object of the present invention to provide an active hydraulic fluid accumulator having an electric motor and a mechanical rotation to translation transducer for use in hydraulic control systems.

Further objects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
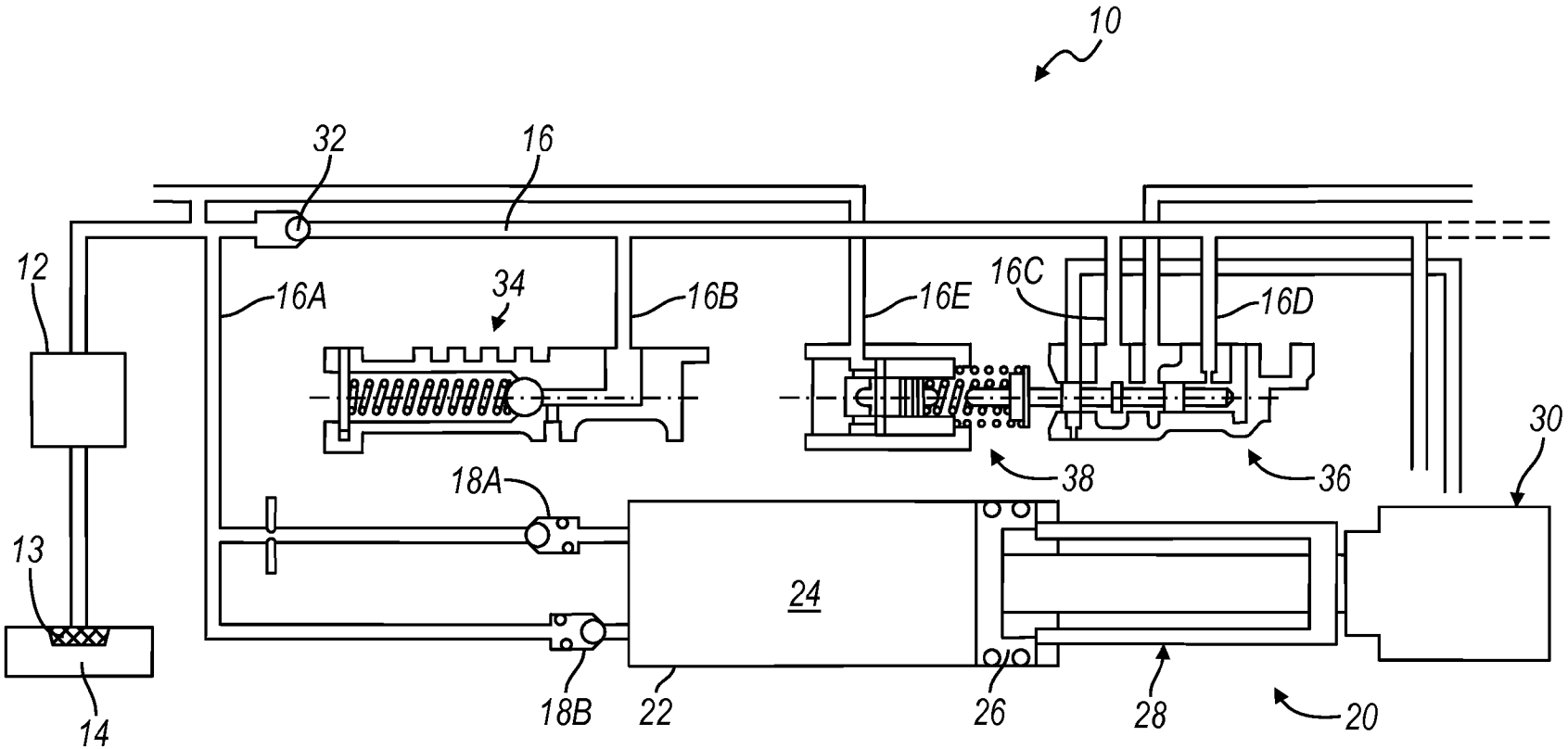
FIG. 1 is a schematic diagram of an active electric accumulator according to the present invention in a first hydraulic fluid system application.

With reference to FIG. 1, a portion of a hydraulic system incorporating the present invention is illustrated and generally designated by the reference number 10. The hydraulic system 10 includes a main hydraulic pump 12 which draws hydraulic fluid through a filter 13 from a sump 14. The hydraulic pump 12 may be a gear pump, a gerotor pump or other, preferably positive displacement, pump typically driven by a prime mover (not illustrated) such as an internal combustion gas or Diesel engine or hybrid or electric power plant.

A main branching supply line 16 leads from the output of the main hydraulic pump 12 to a first line 16A which bifurcates and includes a pair of oppositely arranged spring biased check valves 18A and 18B. The first line 16A functions as a supply and return line to an active electric accumulator 20.

The pair of spring biased check valves 18A and 18B inhibit flow into and out of the active accumulator 20 until predetermined pressure differentials are achieved across them. The active electric accumulator 20 includes a cylindrical housing 22 defining a cylinder 24 which receives a piston 26. The piston 26 is coupled to and driven by a mechanical rotation to linear translation transducer assembly 28 which, in turn, is driven by an electric drive assembly 30. These components of the active electric accumulator 20 will be more fully described subsequently.

The main supply line 16 includes a first check valve 32 which allows fluid flow from the hydraulic pump 12 and the active accumulator 20 to downstream lines and components of the hydraulic system 10 such as a second line 16B which communicates with a pressure relief valve 34 and other components but inhibits return or reverse flow from such components to the hydraulic pump 12 and active accumulator 20. The main branching supply line 16 also includes, solely by way of example and illustration, a third line 16C and a fourth line 16D which supply hydraulic fluid to certain ports of a hydraulic pressure regulator or spool valve 36 as well as an additional branch 16E. The hydraulic pressure regulator or spool valve 36 is controlled by an actuator 38.

Figure 2:
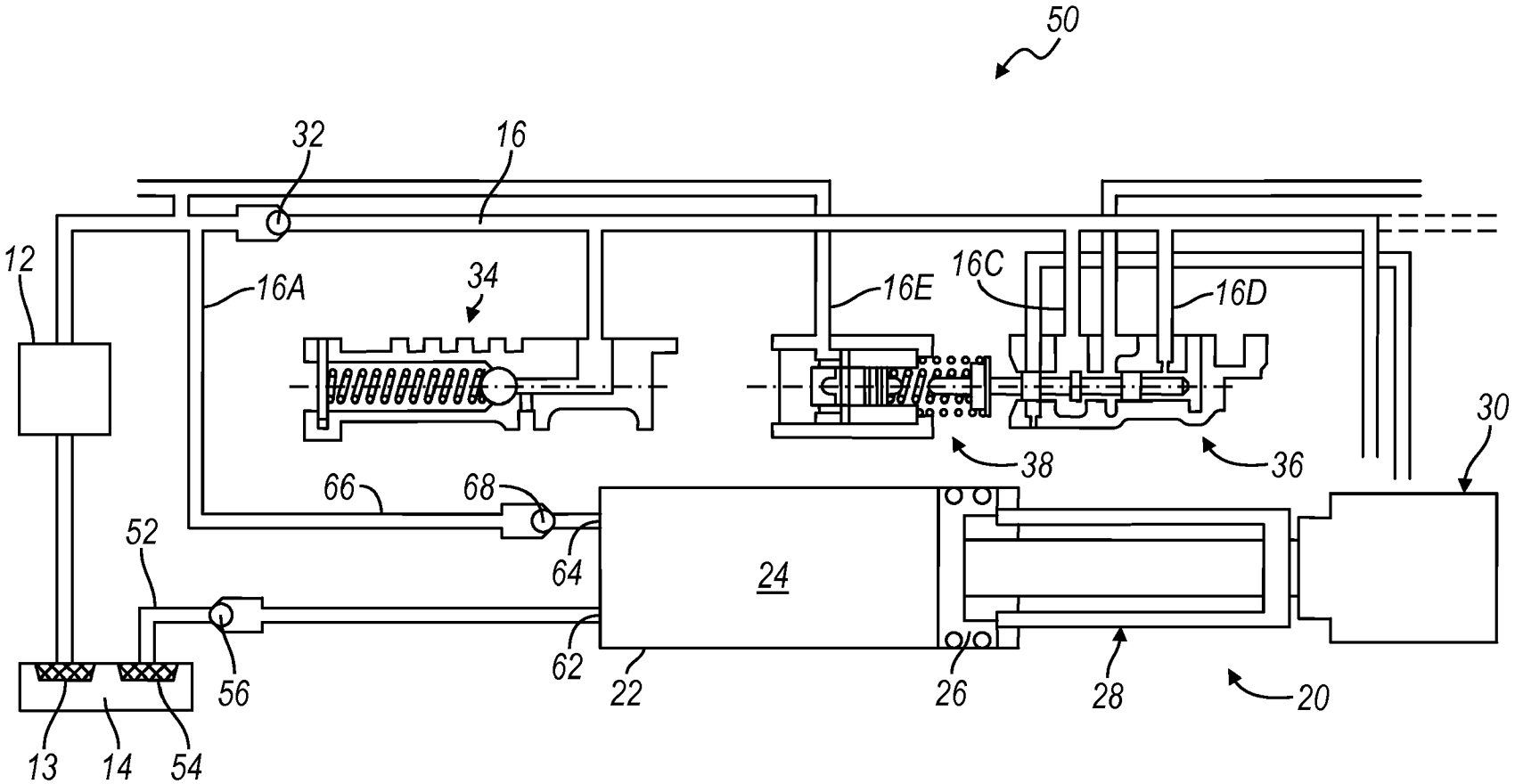
FIG. 2 is a schematic diagram of an active electric accumulator according to the present invention in a second hydraulic fluid system application.

Referring now to FIG. 2, a portion of a second hydraulic system incorporating the present invention is illustrated and generally designated by the reference number 50. The second hydraulic system 50 includes the hydraulic pump 12 which is, again, preferably a positive displacement type which draws hydraulic fluid through the filter 13 from the sump 14. The hydraulic pump 12 is typically driven by a prime mover (not illustrated). The second hydraulic system 50 also includes the main branching supply line 16, the active accumulator 20, the first check valve 32, and, solely by way of example and illustration, the hydraulic lines 16B, 16C, 16D, and 16E, the pressure relief valve 34, the hydraulic pressure regulator or spool valve 36 and the actuator 38.

In the second hydraulic system 50, an accumulator supply line 52, preferably including a filter 54, leads from the sump 14 to an intake check valve 56 which is arranged in the accumulator supply line 52 to permit hydraulic fluid flow from the sump 14 but inhibit return flow to it. The accumulator supply line 52 communicates with and terminates at an inlet port 62 in the housing 22 of the active accumulator 20 which communicates with the cylinder 24. An outlet port 64 in the housing 22 communicates with a system supply line 66 having an outflow check valve 68 which is arranged to permit hydraulic fluid flow from the cylinder 24 to the main branching supply line 16 but inhibit return flow to it. The active accumulator 20 also includes the cylinder 24, the piston 26, the mechanical rotation to linear translation transducer assembly 28 and the electric drive assembly 30.

In the second hydraulic system 50, the active electric accumulator 20 is arranged in parallel with the primary source of pressurized hydraulic fluid, the hydraulic pump 12, and thus may function as a second, essentially independent, though limited, source of pressurized hydraulic fluid. Since the active electric accumulator 20 can operate independently of the hydraulic pump 12, it is preferably disposed within the sump 14, with its inlet below the nominal fluid level, such that it has a ready supply of hydraulic fluid wholly independent of the operation and supply from the pump 12.

Figure 3:
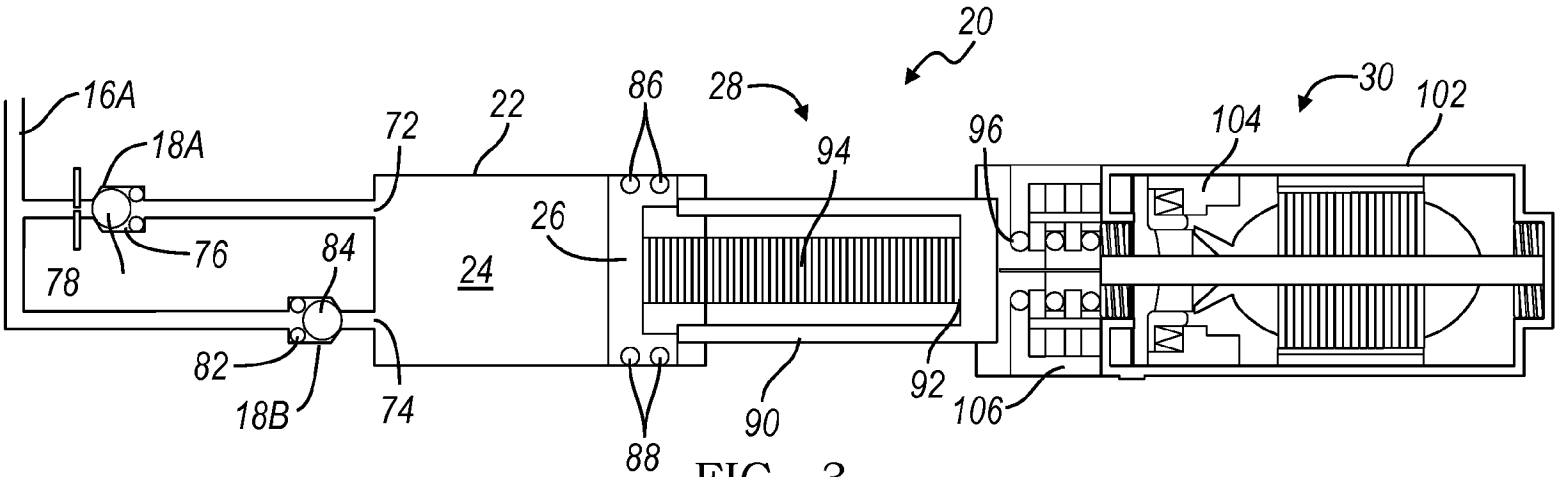
FIG. 3 is a full sectional view of a first embodiment of an active electric accumulator according to the present invention.

Referring now to FIG. 3, a first embodiment of the active electric accumulator 20 is illustrated. As noted, the active electric accumulator 20 includes the preferably cylindrical housing 22 which defines a first, inlet port or passageway 72 and a second, outlet port or passageway 74. If desired, the first and second ports 72 and 74 may be combined into a single port or passageway. The first check valve 18A communicates with the first, inlet port 72 and includes a compression spring 76 which biases the ball check 78 to a closed position until fluid pressure against the ball check 78 overcomes the force of the spring 76 at which time hydraulic fluid flows through the first check valve 18A and through the first, inlet port 72, into the cylinder 24. The second check valve 18B communicates with the second, outlet port 74 and includes a compression spring 82 which biases the ball check 84 to a closed position until fluid pressure against the ball check 84 overcomes the force of the spring 82 at which time hydraulic fluid flows out through the second, outlet port 74 and the second check valve 18B.

The cylindrical housing 22 defines the smooth walled cylinder 24 which slidably receives the piston 26. The piston 26 defines a pair of circumferential grooves or channels 86 which each receives and retains an O-ring seal 88. The piston 26 is coupled to an intermediate, elongate tubular member 90 which defines a portion of the rotation to translation transducer assembly 28. The tubular member 90 includes a coaxially disposed opening having internal or female threads 92. The threads 92 are engaged by a complementarily threaded rod or leadscrew 94 which is bi-directionally rotated by an output member 96 of the electric drive assembly 30. It will be appreciated that other rotation to translation mechanical transducers, for example, ball splines, coil springs, cams and the like, may be substituted for the complementarily threaded members described, all of which are deemed to be within the scope and teaching of the present invention.

In the first embodiment of the active electric accumulator 20, the electric drive assembly 30 includes a bidirectional, fractional horsepower electric motor 102 having an output shaft 104 which is coupled to and drives an input member of a planetary gear speed reduction assembly 106 which drives the output member 96. The output member 96 may be, for example, a shaft or a planet gear carrier which is coupled to the threaded shaft or leadscrew 94 by splines or other suitable connection. The electric motor 102 may by in fluid communication with the cylinder 24 in which case the hydraulic fluid acts as a coolant and heat transfer medium for the motor 102 or it may be permanently sealed. Additionally, the electric motor 102 may be disposed within the cylindrical housing 22 or it may be externally mounted and attached thereto.

With regard to the planetary assembly 106, although other types of speed reduction assemblies may readily be utilized, planetary gear assemblies are preferred because of their concentric configuration and the ease with which a multiple stage planetary gear assembly may be designed and packaged. Depending upon the desired response speed versus pressure characteristics of the active accumulator 20, a single or a double planetary gear train may be incorporated into the speed reduction assembly 106.

Figure 4:
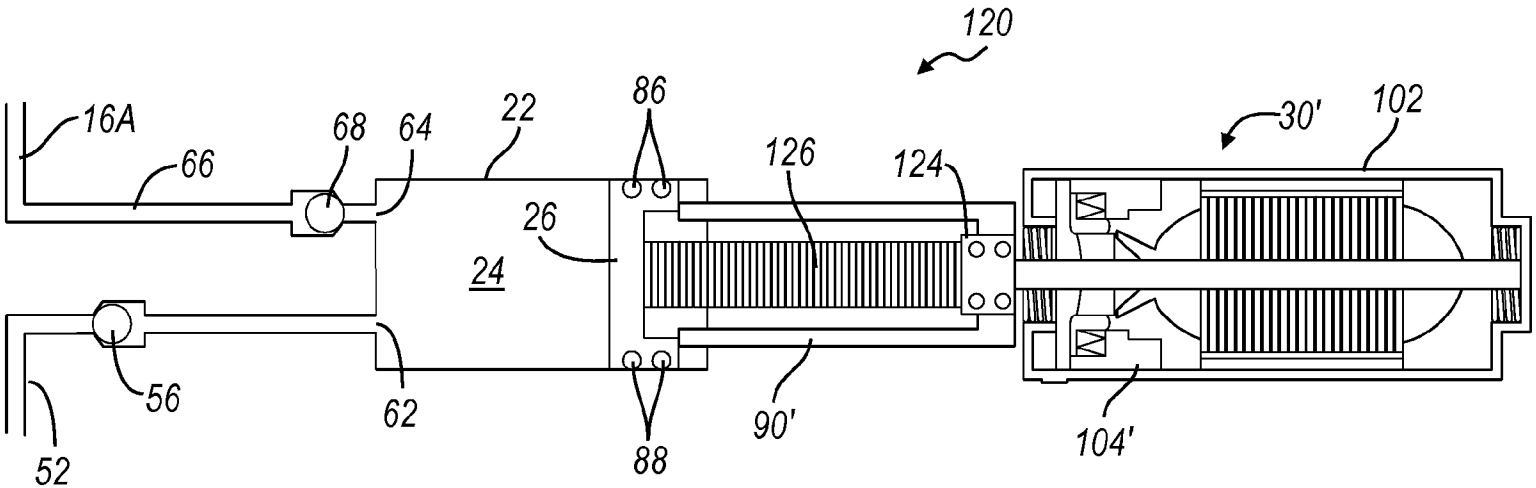
FIG. 4 is a full sectional view of a second embodiment of an active electric accumulator according to the present invention.

Referring now to FIG. 4, a second embodiment of an active electric accumulator according to the present invention is illustrated and generally designated by the reference number 120. The second embodiment active electric accumulator 120 incorporates the same cylindrical housing 22 which defines the same cylinder 24 in which the same piston 26 resides and bi-directionally translates. The piston 26 includes the two circumferential grooves or channels 86 which each receive an O-ring seal 88. The piston 26 is coupled to an elongate tubular member 90' having a recirculating ball nut or ball spline assembly 124 at its end opposite the piston 26. The recirculating ball nut or ball spline assembly 124 receives a threaded shaft or leadscrew 126 having male or external threads complementary to the configuration of the recirculating ball nut assembly 124. Bi-directional rotation of the shaft or leadscrew 126 bi-directionally translates the piston 26 within the cylinder 24. The threaded shaft or leadscrew 126 is coupled to and bi-directionally rotated by an output shaft 104' of the bi-directional, fractional horsepower electric motor 102.

The direct drive configuration of the second embodiment active electric accumulator 120 provides relatively faster response and fluid flows than the reduced speed drive of the first embodiment active electric accumulator 20 which is capable of operating at and providing relatively higher fluid pressures. Thus, whether a single or multiple stage gear speed reduction assembly 106 such as illustrated in FIG. 3 or a direct drive assembly such as illustrated in FIG. 4 is utilized in an active electric fluid accumulator according to the present invention is dependent upon system hydraulic fluid flow and pressure requirements and operating parameters as well as the power output of the electric motor 102.

It should be appreciated that although the first embodiment active electric accumulator 20 has been generally illustrated and described in FIG. 3 in conjunction with the hydraulic system 10 and that the second embodiment active electric accumulator 120 has been generally illustrated and described in FIG. 4 in conjunction with the hydraulic system 50, either active accumulator is suitable and appropriate for use in either system. Likewise, although the planetary gear speed reduction assembly 106 in FIG. 3 has been described in conjunction with the threads 90 in the tubular member 90 whereas the direct drive configuration of FIG. 4 has been described in conjunction with the recirculating ball nut or ball spline assembly 124, either mechanical transducer assembly 28 may be utilized with either electric drive assembly 30.

It should also be appreciated that the active electric accumulators 20 and 120 according to the present invention provide numerous advantages and benefits relative to conventional, passive accumulators. First of all, the accumulators 20 and 120 can be fully charged by actuation of the electric motor 102. Thus, even before system start-up, the accumulator may be fully charged and ready to provide its intended function. A second benefit, also related to the independent operation of the electric motor 102 is that the accumulators 20 and 120 can be filled or charged without or independent of the establishment of system fluid pressure or flow. Furthermore, by modulating the speed of the electric motor 102, the rate of re-fill or re-charge and discharge may be controlled. Finally, the accumulators 20 and 120 can be utilized as low flow and pressure pumps, supplementing or substituting for the main system hydraulic pump 12 during brief periods of high system flow demand or other transient conditions.

The description of the invention is merely exemplary in nature and variations that do not depart from the gist of the invention are intended to be within the scope of the invention. Such variations are not to be regarded as a departure from the spirit and scope of the invention.

What is claimed is:

1. An active accumulator for a hydraulic system comprising, in combination, a housing defining a cylinder and including an inlet port and an outlet port communicating with said cylinder, a piston slidably disposed within said cylinder, a first check valve in fluid communication with said inlet port and a second check valve in fluid communication with said outlet port, a hydraulic fluid sump and a line communicating between said sump and said first check valve, an electric motor assembly having a bi-directionally rotating output, a planetary gear set having an input member and an output member, wherein said input member is connected to said bi-directionally rotating output of the electric motor assembly, and means operably disposed between said output member of said planetary gear set and said piston for converting said rotating output to linear translation.

2. The active accumulator of claim 1 wherein said electric motor assembly includes a bi-directional electric motor.

3. The active accumulator of claim 1 wherein said means for converting includes a threaded shaft and a thread engaging member on said shaft.

4. The active accumulator of claim 1 wherein said piston includes two circumferential grooves in each of which is disposed an o-ring seal.

5. The active accumulator of claim 1 wherein said electric motor assembly is coupled to said input of the planetary gear set and the bi-directionally rotating output is a planet gear carrier of the planetary gear set.

6. The active accumulator of claim 1 wherein said planetary gear set is a double planetary gear train.

7. An active electric accumulator for a hydraulic system comprising, in combination, a housing defining a cylinder and a first fluid passageway through said housing into said cylinder, a first check valve in fluid communication with said first fluid passageway for allowing fluid flow into said cylinder, a second check valve in fluid communication with said first fluid passageway for allowing fluid flow out of said cylinder, a hydraulic fluid sump and a hydraulic line communicating between said sump and said first check valve, a piston disposed for bi-directional translation within said cylinder, an electric motor assembly having a bi-directionally rotating output, a planetary gear set having an input member and an output member, wherein said input member is connected to said bi-directionally rotating output of the electric motor assembly, and means mechanically coupling said output member of said planetary gear set and said piston for changing bi-directional rotation into bi-directional translation.

8. The active electric accumulator of claim 7 further including a second fluid passageway through said housing into said cylinder, a first check valve in fluid communication with said first fluid passageway for allowing fluid flow into said cylinder and a second check valve in fluid communication with said second fluid passageway for allowing fluid flow out of said cylinder.

9. The active electric accumulator of claim 7 wherein said electric motor assembly includes a bi-directional electric motor.

10. The active electric accumulator of claim 7 wherein said means for changing includes a ball screw assembly.

11. The active electric accumulator of claim 7 wherein said piston includes two circumferential grooves in each of which is disposed an o-ring seal.

12. The active electric accumulator of claim 7 wherein said electric motor assembly is coupled to said input of the planetary gear set and the bi-directionally rotating output is a planet gear carrier of the planetary gear set.

13. The active electric accumulator of claim 7 wherein said planetary gear set is a double planetary gear train.

14. An active electric accumulator for a hydraulic system comprising, in combination, a housing defining a cylinder and a first fluid opening through said housing into said cylinder, a piston disposed within said cylinder for bi-directional translation toward and away from said opening, a first check valve in fluid communication with said fluid opening for allowing fluid flow into said cylinder, a second check valve in fluid communication with said fluid passageway for allowing fluid flow out of said cylinder, a fluid sump and wherein said first check valve is in fluid communication with said fluid sump, an electric motor assembly having a bi-directionally rotating output, and a planetary gear set having an input member and an output member, wherein said input member is connected to said bi-directionally rotating output of the electric motor assembly, and a threaded shaft coupled to said output member of said planetary gear set and a complementary member disposed about said shaft and coupled to said piston, whereby bi-directional rotation of said shaft bi-directionally translates said piston.

15. The active electric accumulator of claim 14 further including a second opening in said housing and wherein one of said check valves communicates through one of said openings with said cylinder and another of said check valves communicates through another of said openings with said cylinder.

* * * * *